United States Patent [19]

Marshall et al.

[11] 4,449,540

[45] May 22, 1984

[54] SEPARATION OF LAMINA FROM STEMS IN BALED TOBACCO

[75] Inventors: Charles W. Marshall; William F. Lineberger; Samuel A. Parker, Jr., all of Maysville, Ky.

[73] Assignee: Parker Tobacco Company, Maysville, Ky.

[21] Appl. No.: 349,521

[22] Filed: Feb. 17, 1982

[51] Int. Cl.[3] ..... A24B 5/00; A24B 7/12

[52] U.S. Cl. ..... 131/290; 131/311; 131/312; 131/313; 131/320; 131/317

[58] Field of Search ..... 130/30 R; 131/290, 313, 131/322, 323, 326, 317, 320, 312, 311, 364

[56] References Cited

U.S. PATENT DOCUMENTS

| | | | |
|---|---|---|---|
| 42,644 | 5/1864 | Davis | 131/290 |
| 3,128,775 | 4/1964 | Eissmann | 131/290 |
| 3,219,042 | 11/1965 | Molins | 131/290 |
| 3,659,620 | 5/1972 | Pietrucci et al. | 131/290 |
| 4,074,722 | 2/1978 | Kohnhurst | 131/290 |
| 4,233,996 | 11/1980 | Brackmann et al. | 131/290 |

*Primary Examiner*—V. Millin

*Attorney, Agent, or Firm*—Wood, Herron & Evans

[57] ABSTRACT

Disclosed is a method and apparatus for processing baled tobacco leaves to separate the lamina portions of the leaves from the stem portions. The bale is cut symmetrically, crosswise to its length, into three or preferably five separate sections, of different characteristic types. A center section is cut from the middle of the bale. On each side of the center section a second section is cut; and two end sections are preferably cut, one at each end of the bale. The different types of sections have different lamina-to-stem ratios, and are processed differently. The second sections are coarsely threshed, to dislodge the larger lamina portions of the leaves from the stem portions therein, and the coarsely threshed material is separated into a first light fraction (comprising mostly lamina) and a first heavy fraction (enriched in stem content). The center section can be combined with the light fraction and can be dried and packed without the necessity of further threshing. If end sections are cut, the first heavy fraction is combined with them and is more finely threshed, to dislodge remaining lamina portions from the stem portions therein.

26 Claims, 3 Drawing Figures

SEPARATION OF LAMINA FROM STEMS IN BALED TOBACCO

FIELD OF THE INVENTION

This invention relates to a process and apparatus for separating lamina portions from stem portions of tobacco leaves in baled form.

BACKGROUND

For the manufacture of cigarettes and other tobacco products it is necessary that the relatively dense and rigid stem of the tobacco leaf be separated from the remainder of the leaf, which is known as the "strip" or "lamina." While the stems can be incorporated in tobacco products, because of their rigid character they must go through a separate set of processing operations before they can be blended back with the lamina. Not all of the stem must be removed, only what is defined as "objectionable stem" having a diameter in excess of a dimension specified by the manufacturer.

To separate objectionable stems from the lamina, a process known as threshing is used, in which the leaves are torn or shredded by rotating fingers or vanes into progressively smaller pieces. In the process, lamina portions tend to be dislodged from stem portions. The threshed material is then "classified" or separated into a lighter fraction, which comprises a higher lamina content than the feed, and a heavier fraction, comprising higher proportion of stem than the feed. Such separation is typically carried out as an air separation wherein an air current lifts and carries off the lighter pieces from the heavier pieces. Typically several threshing stages are employed; by repeatedly threshing the heavy or stem rich portions to finer pieces, remaining portions of lamina attached to the stems ("flags") are dislodged and separated as lighter fractions, until virtually all the lamina has been separated. Often five, and sometimes as many as seven or even more progressively finer threshing stages may be used, with a separation after each stage.

The particular manner in which tobacco is threshed depends on the type of "package" in which it is delivered by the grower. In general, three different types of "packages" are in common use. Some tobacco, especially flue cured tobacco, is sold in "sheets," wherein individual leaves, stripped from the stalk, are placed loosely in an unoriented and random manner in a large burlap sheet and the corners tied together. These sheets of leaves are dumped directly into the threshing process without attempting to orient the leaves; the cost of orienting leaves would be excessive. This is called "whole threshing"; it requires more threshing capacity, because the entire leaf must be threshed. Whole threshing produces relatively more fines.

Tobacco is also sold in the form of "hands," in which the leaves are arranged with their stem ends together, tied with another leaf. The leaves in a hand are usually of somewhat different lengths, so that while the stems are together at the butt, the leaf tips are not all at the same position. Tobacco in hand form can be whole threshed, as with sheets; or it can be tipped and threshed. In the latter process each hand is manually placed on a conveyor, with the end opposite from the butt aligned against a guide rail. So aligned, the hands are conveyed past rotating cutters which cut off the outer 8" to 12" of the hands. The cut-off portions average roughly 10% by weight of the hands; because they have almost no stem content, they are not threshed. The remaining approximately 90% of the hands must however be threshed. Tipping and threshing hand tobacco thus requires a little less threshing capacity than whole threshing, but is more labor intensive because of the manual effort required to properly position the hands on the conveyor.

Recently, tobacco as increasingly being marketed in bale form, a third type of "package." In baling, the individual leaves are arranged in a bale-forming box so that their stems are at the respective ends of the box, with the tips pointing toward the opposite ends of the box. However, the tips are not necessarily at the center of the bale: the tip of a long leaf (for example 24" to 30" long) will extend past the center and may approach the opposite end, whereas the tip of a short leaf (less than 18" long) will not extend to the center. When short leaves are being baled, some leaves may be placed centrally in the forming box, to act as bridges between the leaves on each side of center. The bale is compacted under pressure and is tied transversely. Bailing is further described in "Packaging and Handling Burley Tobacco in Bales at the Farm," by Duncan and Smiley, University of Kentucky College of Agriculture, publication ID-39, to which reference may be had.

Baled tobacco can either be whole threshed, or tipped and threshed. Whole threshing capacity requirements for bales are similar to those for sheeted tabacco. Bales to be tipped and threshed are separated into longitudinal layers (roughly 2" to 4" thick), and then these layers are pulled apart endwise to form two rough halves. However, pulling bale layers into halves is a laborious job; the layers, compacted under pressure, are not easily separated transversely. Moreover, additional fines are produced when layers are pulled apart. Once separated, each half layer is then placed on a conveyor with its "non-stem" end adjacent a guide rail. That end is cut off and the remainder of the half layer is threshed as previously described. The cut off ends (roughly 10% of the weight of the bale) can be processed without threshing, but a very large proportion of the bale still must be threshed, and again, a relatively large investment in threshing capacity is required to handle a given number of bales per unit time.

BRIEF DESCRIPTION OF THE PRESENT INVENTION

This invention is directed to an improved method and apparatus for threshing tobacco leaves which are in the bale form. In comparison to the previous methods of threshing baled tobacco, it greatly increases the threshing capacity and it also reduces the amount of manual labor required to handle a given number of bales per day.

A method has been found whereby a bale can easily be divided into sections of very different lamina/stem proportions, and whereby these different sections can be processed differently, to separate objectionable stems with far less threshing and labor than has previously been required.

In accordance with this invention the tobacco bales, preferably separated into layers, are simultaneously cut into three, or preferably five, separate transverse sections, or "cuts," of different characteristic types. The cutting is preferably done simultaneously by spaced pairs of rotating circular knives. The middle part of the bale is cut to form a so-called center section or cut.

Outwardly, that is, toward the ends of the bale, second sections are cut on each side of the center section. Preferably the two ends of the bale are cut from the second cuts, to form end sections or butts. Preferably four cuts are made, which define five bale sections: a center section, two second sections, and two end sections.

By analysis it has been found that the characteristics of the different types of sections vary substantially in their lamina-to-stem ratios. These cuts are positioned to take advantage of observed differences in the lamina-to-stem ratios of the tobacco along the length of the bale. While the precise ratios will vary depending upon the size and type of leaves in the particular bale, and on section width, an analysis of center, second, and end sections, cut by knives on 9" centers, shows these proportions:

| Section | Width | % of total bale wt. | wt. % lamina | wt. % stem | lamina-to-stem ratio |
|---|---|---|---|---|---|
| Center | 9" | 30 | 94 | 6 | 16 |
| Second | 9" | 58 | 78 | 22 | 4 |
| End | 4½" | 12 | 44 | 56 | 0.8 |
| Total bale | 36" | 100% | 79% | 21% | 4 |

It was further found, in this sample, that the center section comprised about 92% by weight of tobacco tip, whereas the second section comprised only about 2.5% tip. From the foregoing it can be seen that the center section has a much higher lamina-to-stem ratio than the second sections and/or the end sections and that the second sections have a much higher lamina-to-stem ratio than the end section (16:4:0.8).

In carrying out this process, the bale is preferably manually "flaked" into slabs or layers before it enters the cutters, so that the entire bale is not sliced at once. The cutters themselves preferably comprise overlapping circular rotating knife blades, which provide a "scissors" shearing action between them. This is found to produce less fines than sawing or cutting with a serrated edge. The bale is cut symmetrically; by two or preferably four pair of knives positioned symmetrically about a transverse plane passing through the midpoint of the bale, so that both second sections have the same width and both end sections (if cut) have the same width.

Typically the second sections will comprise the largest proportion by weight, usually more than half the weight of the entire bale. The second sections are coarsely threshed, to produce pieces of lamina as large as possible, some being as large as 2½" to 4" in major dimension. The particular size of the threshed pieces is not critical, but is illustrative of the relative coarseness of this threshing in comparison to the finer threshing later carried out. This coarse threshing dislodges the larger lamina portions from stem portions. The coarsely threshed material is then subjected to separation step, as by air separation, which divides it into a first light fraction (enriched in lamina content) and a first heavy fraction (enriched in stem content as compared to the whole leaf). (Optionally, it may be desirable or advantageous to subject the heavy fraction to a further threshing and separation, before the fine separation. That is, the coarse threshing step may be carried out in one, two, or even more coarse threshing and separating stages.)

The first heavy fraction, combined with the end sections, if the latter are cut, is given a finer threshing, which dislodges the smaller pieces of lamina still attached to the stem portions. The product is then separated into second light and heavy fractions. Again, the fine threshing step may be carried out in several fine threshing and separating stages.

The center cuts are not threshed. Because they typically comprise the next largest portion of the bale (after the second cuts), roughly about ⅓ the weight of the bale, this greatly reduces the volume of material to be threshed. The analytical discovery that as much as ⅓ of the tobacco in a bale can be easily separated and used without threshing is surprising, in view of the various positions of the leaves in the bale. This discovery enables the threshing capacity of a given existing installation to be substantially increased, for example by about 20%; and it greatly reduces the hand labor previously required.

The first light fraction, separated after the coarse threshing, and the second light fraction, separated after the fine threshing, are combined with the center cuts and can be dried and packed without further threshing.

The second heavy fraction, separated after the fine threshing is, in a practical sense, only the stem portions; and it can be packed as stems.

As has been indicated, it is desirable but not absolutely necessary to cut end sections off from the second sections, and to process them differently. This leads to further capacity improvements, because it is found that the end sections (about ⅛ of bale weight) do not require coarse threshing at all, and that they can be sent directly to fine threshing with the first heavy fraction.

The foregoing brief description of the invention omits conventional processing steps such as blending, ordering, picking, screening, and drying. These are well known in the art and do not themselves comprise the invention or a necessary part of it; they are optional and may be used, and desirably will be used. For example, it is desirable before threshing to loosen or fluff the leaf portions of the various sections, as by tumbling. The leaves are desirably "ordered" or subjected to moistening, for example by wet steam, to increase their water content so that they are less brittle and thus less likely to crumble and produce fines. It is also conventional to inspect or "pick" the leaf portions in order to remove green leaves, leaves of inferior quality, and so on. Those treatments may be as conventionally practiced.

DESCRIPTION OF THE DRAWINGS

The invention can best be further described by reference to the accompanying drawings, in which.

DETAILED DESCRIPTION

Figure 1:
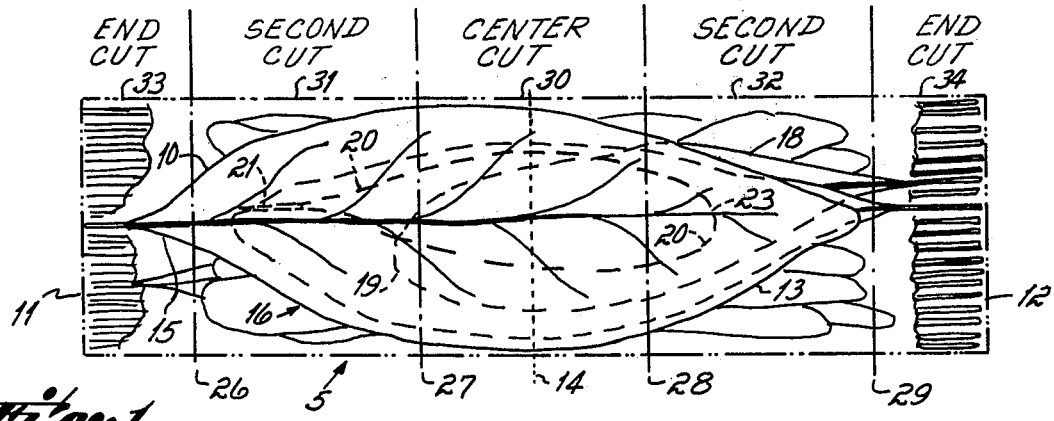
FIG. 1 is a plan view of a bale of tobacco, showing diagrammatically the arrangement of the leaves and indicating preferred positions of the cuts.

Although the stem ends of most leaves are at the ends of the bale, the tips of the leaves are not necessarily at the center, or even together. FIG. 1 illustrates various relative positions of leaves in the bale. A long leaf, as designated at 10, will extend from one end 11 of the bale 5 most of the way to the other bale end 12. The tip portion 13 of this leaf extends beyond thetransverse midplane 14 of the bale. The stem or butt portion of the leaf is designated generally at 15. Between this and the tip is the leaf body portion, designated at 16. In the case of a small leaf, as designated at 18, the tip end 19 may be nearer to the middle of the box. Bridging leaves as at 20, across the middle of the bale, help unite the ends of a bale of short leaves. The stem end 21 of a bridging leaf 20 will not be at the end of the bale, but may for example overlie the body portion 16 of a long leaf, and the tip end 23 of the bridging leaf will overlie the body of another underlying leaf 18.

In the preferred practice of the invention, the bale is separated into layers which are separately cut into five sections, at positions indicated by the dotted lines 26, 27, 28 and 29. The cuts are preferably symmetrically disposed, two on either side of the center plane 14. These preferred four cuts 26-29 define a center bale section or cut 30 between cut lines 27 and 28, second sections or cuts 31 and 32 on either side of center section 30, and end sections 33 and 34. It is desirable that the center section comprise about 20% to 40% of the length of the bale, whether or not end sections are cut, and most preferably that it be about nine inches long, that is, one-quarter of the length of the bale. Where end sections are cut, it is desirable that the second sections total about 40% to 70% of the bale length, and most preferably that each second section also be about nine inches long. The end sections, if they are cut, are each preferably about ⅛ of the bale length, i.e., 4½ inches. Thus, the cut lines are most preferably uniformly spaced at nine inches although the optimum may vary depending on the type and average length of leaves in the bales.

Figure 3:
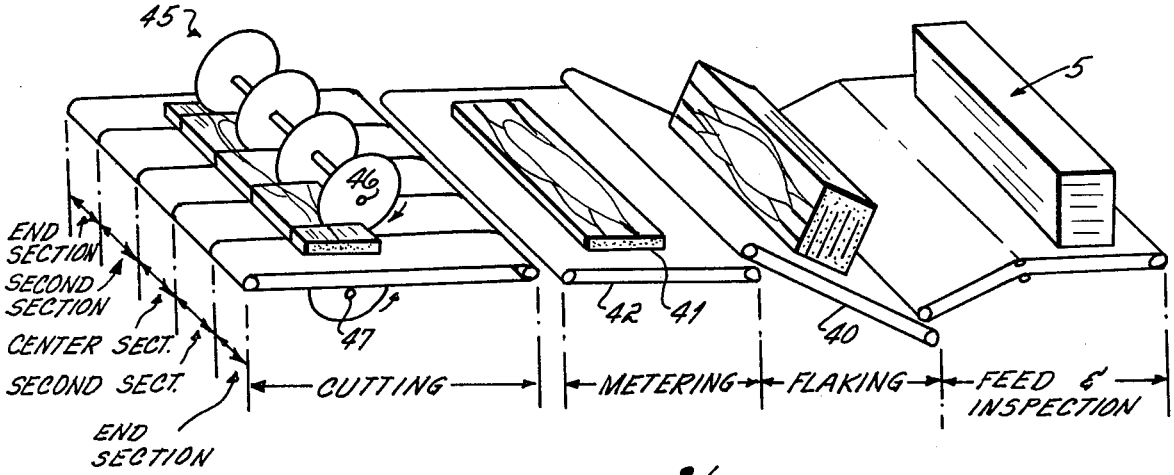
FIG. 3 is a view showing a preferred form of bale cutting apparatus for use in the invention.

Because the bale is about 24" high and 12" wide, it is cut more easily if it is first separated into layers, as is next described in relation to FIG. 3. The incoming bale 5 is fed onto an inclined conveyor 40 after inspection and after any binding twine has been removed. As the bale approaches an upper end of the inclined conveyor 40 it is subdivided manually, by flipping off successive layers, one of which is shown at 41, which drop onto a lower or feed conveyor 42 that carries them horizontally through the ganged cutters 45.

A preferred form of cutting means, if the bale is separated into layers 41, is shown in FIG. 3, and comprises four opposed pairs of circular knives ganged on two parallel driven shafts 46 and 47. The knives, which may suitably be 12 to 20 inches in diameter, are driven in the directions as indicated by the arrows, to pull the layer between them. The two cutters of each pair provide a shearing action between them. The layers are supported during cutting on five separate take-off conveyors, each section being carried off separately for the different processing shown in FIG. 2, as further described below.

Figure 2:
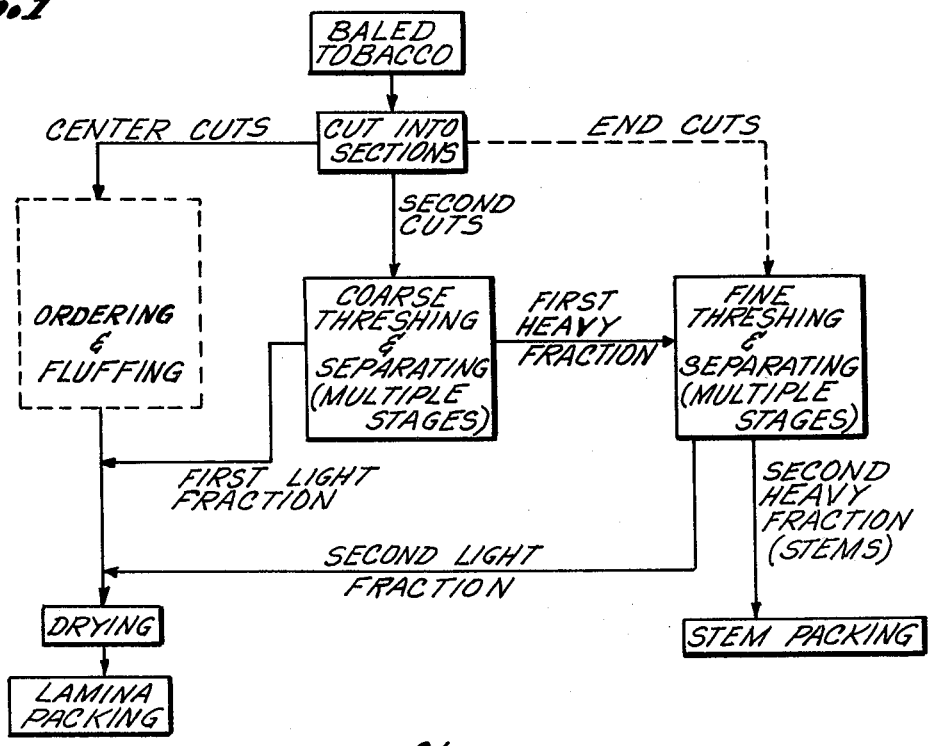
FIG. 2 is a diagrammatic flow sheet illustrating the preferred practice of the method of the invention.

The preferred practice of the process of the invention is shown in FIG. 2. The center cuts, roughly one quarter of the bale length, comprise roughly one-third of the total bale weight. The second sections are roughly half the bale length and comprise a little more than half the bale weight; the end sections totaling about one quarter of the bale length, are only about ⅛ of the bale weight.

It is found that the center cuts, as indicated by the bale analysis, are typically so free of objectionable stem that this one-third portion need not be threshed at all. Moreover, the first light fraction, separated after the coarse threshing, which may comprise about ⅓ of the bale weight, need not be further threshed. Also, the end cuts need not be coarsely threshed; separating them from the second cuts provides a further increase in threshing capacity of a given line.

In the context of this invention, "coarse threshing" means, threshing between relatively moving parts or to pass through a basket, the clearance of either of which is approximately 2" or more; and "fine threshing" refers to a product threshed to pass through basket openings approximately b 2" or smaller.

In the preferred practice of the invention, the initial coarse threshing and separating step is carried out in two stages: a first stage wherein the material is threshed to pass product openings in the range of 2½ to 3½", followed by an air separation, then a second coarse threshing stage, wherein the heavy portions from the separation are threshed to pass through openings in the range of about 2" to 2½", and are air separated. The light fractions from these two stages are desirably screened to remove fines; together they comprise the "first light fraction" which is added to the unthreshed center cuts.

Similarly, in practice the finer threshing step also desirably comprises multiple threshing and separation stages, to pass through basket openings of about 2", 1½" and 1", each stage being followed by a separation. In each case the light fractions are desirably screened to remove fine particles or dust, and are added to the center cuts and the first light fractions, as shown.

By way of comparative example, the present practice, described earlier, of tipping and threshing bales by pulling them apart manually, requires 28 people on the input to the threshing line, to process 1700 bales/day. The process herein described, for the same throughput, can be carried out with only eight people on the input to the threshing line. This is better than a three-fold reduction in labor; yet the resulting product is at least of comparable quality.

As already noted, this invention can be practiced either by cutting the whole bale, or by "flaking" longitudinal layers from the bale, then cutting the layers. As used herein the term "baled tobacco" is meant to encompass a whole bale, as well as a longitudinal layer separated from a whole bale.

Having described the invention, what is claimed is:

1. A process for separating the lamina portions of baled tobacco leaves from stem portions thereof, comprising, conveying baled tobacco in the form of either a whole bale or a layer of tobacco leaves separated from a bale, wherein the leaves are oriented with their stems at the ends of the baled tobacco and their tips are inward, cutting said baled tobacco into at least three tranverse sections, including a center section and two second sections, one on each side of the center section, the center section comprising a portion which was at the longitudinal middle of the bale and having a substantially lower proportion of stem than the second sections, directly after such cutting, conveying the second sections separately from the center section, thereby to separate the center section from the second sections, coarsely threshing the second sections, separating the threshed second sections into a first light fraction and a first heavy fraction, finely threshing the first heavy fraction to dislodge additional lamina portions thereof, separating the finely threshed material into a second light fraction and a second heavy fraction, the latter comprising principally stem portions, and combining the center section with the first and second light fractions, thereby forming a fraction comprising principally lamina portions.

2. The process of claim 1 further wherein the baled tobacco is cut into five tranverse sections, comprising the center section, the two second sections, and two end sections one at each end of the baled tobacco; and wherein the end sections are mixed with the first heavy fraction in the fine threshing step.

3. The process of claim 2 wherein the baled tobacco is cut so that the center section comprises about 20 to 40% of the length of the bale.

4. The process of claim 1 wherein the baled tobacco is cut so that the second section comprises about 15 to 40% of the length of the bale.

5. The process of claim 1 wherein the center section and second sections are of approximately equal width.

6. The process of claim 1 wherein the cuts are simultaneously made, symmetrically on each side of a plane passing transversely through the center of the baled tobacco.

7. The process of claim 1 wherein the cutting is carried out while the baled tobacco is being conveyed in a direction transversely of its length.

8. The process of claim 1 including the preliminary step of separating the whole bale into longitudinal layers extending the length of the bale, then cutting the layers as decribed.

9. The process of claim 1 wherein the coarse threshing is carried out through openings of at least about 2".

10. The process of claim 1 wherein the fine threshing produces a product which passes through basket openings no larger than about 2".

11. The process of claim 1 wherein the coarse threshing and separating step comprises multiple stages, with the second sections being threshed and separated more than once, before the heavier fractions thereof are combined with the end sections.

12. The process of claim 2 wherein the end sections and heavier fraction combined therewith are threshed and separated in multiple stages.

13. Apparatus for processing baled tobacco in the form of either a whole bale or longitudinal layers of tobacco leaves separated from a bale, the baled tobacco containing leaves oriented with their stems toward the ends and their tips inward, comprising feed conveyor means for conveying the baled tobacco, means for cutting the baled tobacco transversely to its length into at least three sections comprising a center section and two second sections, one on each side of the center section, take-off conveyor means for conveying in the second sections separately from the center section after the cutting thereof, means for coarsely threshing the second sections and separating first light and heavy fractions therefrom, means for finely threshing the first heavy fraction and separating second light and heavy fractions therefrom, and means for mixing the first and second light fractions with the center sections without further threshing.

14. Apparatus in accordance with claim 13 wherein the cutting means comprises ganged rotary knives on a shaft.

15. Apparatus in accordance with claim 13, further wherein the cutting means includes rotary knives for cutting five sections comprising, two end sections in addition to the center section and the second sections, the end sections being at the ends of the second sections.

16. Apparatus in accordance with claim 15 wherein the cutting means comprises two parallel driven shafts, each carrying four rotary knives which form coacting pairs of cutters with the respective knives of the other shaft, to shear the tobacco between them.

17. Apparatus in accordance with claim 15 further including means for delivering the end sections to the fine threshing means for threshing therein with the first heavy fraction.

18. Apparatus in accordance with claim 13 wherein the coarse threshing means presents product openings no smaller than about 2 inches.

19. Apparatus in accordance with claim 13 wherein the fine threshing means presents basket openings no larger than about 2 inches.

20. Apparatus for threshing baled tobacco comprising, means for conveying baled tobacco in a direction transverse to its length, the conveying means including an inclined conveyor having an upper end, and a lower conveyor moving below said upper end and receiving layers of tobacco separated from a bale at said upper end and falling onto the lower conveyor therefrom, means for cutting the baled tobacco transversely to its length into at least three sections comprising a center section and two second sections, one on each side of the center section, means for coarsely threshing the second sections and separating first light and heavy fractions therefrom, means for finely threshing the first heavy fraction and separating second light and heavy fractions therefrom, and means for mixing the first and second light fractions with the center sections without further threshing.

21. Apparatus for cutting baled tobacco comprising, means for conveying baled tobacco in a direction transverse to its length, and means for cutting the baled tobacco transversely to its length into at least three sections comprising a center section and two second sections, one on each side of the center section, the conveying means conveying the baled tobacco into and through the cutting means, the cutting means comprising two parallel driven shafts, each carrying rotary knives which form coating pairs of cutters with the respective knives of the other shaft, to shear the tobacco between them.

22. Apparatus in accordance with claim 21, further wherein the cutting means includes rotary knives for cutting five sections comprising two end sections in addition to the center section and the two second sections, the end sections being at the ends of the second sections.

23. Apparatus in accordance with claim 21 wherein the cutting means cut longitudinally extending layers of tobacco separated from the bale, rather than the entire bale.

24. Apparatus in accordance with claim 21 further wherein the conveying means includes an inclined conveyor having an upper end and a lower conveyor moving below said upper end and receiving layers of tobacco separated from a bale at said upper end and falling therefrom onto said lower conveyor.

25. Apparatus in accordance with claim 21 wherein the conveying means includes a separate conveyor for conveying each cut section, the separate conveyors leading from positions between the knives which cut the respective sections.

26. A process for separating the lamina portions of baled tobacco leaves from stem portions thereof, comprising, conveying baled tobacco in the form of either a whole bale or a layer of tobacco leaves separated from a bale, wherein the leaves are oriented with their stems at the ends of the baled tobacco and their tips are inward, cutting said baled tobacco into at least three transverse sections, including a center section and two second sections, one on each side of the center section, the center section comprising a portion which was at the longitudinal middle of the bale and having a substantially lower proportion of stem than the second sections, directly after such cutting, conveying the second sections separately from the center section, thereby to separate the center section from the second sections, and thereafter processing the respective sections separately, in accordance with the proportions of stem and lamina they contain, to separate stems from lamina therein.

* * * * *